US006772441B2

(12) United States Patent
Lucas, Jr.

(10) Patent No.: US 6,772,441 B2
(45) Date of Patent: Aug. 10, 2004

(54) SOCCER GOALKEEPER GLOVE

(76) Inventor: Alfred W. Lucas, Jr., 79 Cheese Factory Rd., Honeoye Falls, NY (US) 14472

( * ) Notice: Subject to any disclaimer, the term of this patent is extended or adjusted under 35 U.S.C. 154(b) by 47 days.

(21) Appl. No.: 10/245,919

(22) Filed: Sep. 18, 2002

(65) Prior Publication Data

US 2003/0154539 A1 Aug. 21, 2003

Related U.S. Application Data

(60) Provisional application No. 60/358,607, filed on Feb. 21, 2002.

(51) Int. Cl.[7] ..... A41D 19/00
(52) U.S. Cl. ..... 2/161.1; 2/163
(58) Field of Search ..... 2/160, 161.1–161.8, 2/163, 167; 441/57

(56) References Cited

U.S. PATENT DOCUMENTS

| | | | | |
|---|---|---|---|---|
| 241,964 A | | 5/1881 | Glidden | |
| 548,541 A | | 10/1895 | Heafield | |
| 613,847 A | | 11/1898 | Rue | |
| 883,761 A | | 4/1908 | Taylor | |
| 1,083,795 A | | 1/1914 | Brokaw | |
| 1,284,178 A | | 11/1918 | Clarke | |
| 1,584,304 A | | 5/1926 | Kennedy | |
| 1,726,728 A | * | 9/1929 | Adams | 441/57 |
| 1,746,268 A | * | 2/1930 | Lepetich | 441/57 |
| 2,095,603 A | | 10/1937 | Langdon | 128/157 |
| 3,333,850 A | | 8/1967 | Miller | 273/54 |
| 3,347,547 A | | 10/1967 | Hynes | 272/67 |
| 3,398,951 A | | 8/1968 | Disko | 273/54 |
| 3,593,803 A | | 7/1971 | Ibach | 172/370 |
| 3,597,765 A | | 8/1971 | Stanton | 2/159 |
| 3,882,548 A | | 5/1975 | Shinagawa et al. | 2/161 A |
| 3,938,207 A | * | 2/1976 | Drescher | 441/57 |
| 3,944,220 A | | 3/1976 | Fasano | 272/67 |
| 4,004,295 A | | 1/1977 | Byrnes, Sr. | 2/161 R |
| 4,295,229 A | * | 10/1981 | Clark et al. | 2/20 |
| 4,669,991 A | * | 6/1987 | Southworth | 441/57 |
| 4,720,875 A | | 1/1988 | Latina et al. | 2/19 |
| 4,881,275 A | | 11/1989 | Cazares et al. | 2/161 A |
| 5,018,221 A | | 5/1991 | Romandetto | 2/16 |
| 5,058,209 A | | 10/1991 | Eisenberg | 2/161 A |
| 5,113,526 A | | 5/1992 | Wang et al. | 2/2 |
| 5,373,585 A | | 12/1994 | Wiggins | 2/159 |
| 5,409,447 A | | 4/1995 | Wedge, Jr. | 601/40 |
| 5,487,188 A | | 1/1996 | Micheloni et al. | 2/16 |
| 5,500,956 A | | 3/1996 | Schulkin et al. | 2/161.1 |
| 5,511,244 A | | 4/1996 | Shikatani | 2/16 |
| 5,608,912 A | * | 3/1997 | Cumberland | 2/16 |
| 5,781,929 A | | 7/1998 | Shikatani | 2/16 |
| D416,111 S | | 11/1999 | Talarico | D29/123 |
| 6,065,155 A | | 5/2000 | Sandusky | 2/161.1 |
| 6,088,835 A | * | 7/2000 | Perkins et al. | 2/161.1 |
| 6,543,058 B2 | * | 4/2003 | Litke | 2/161.2 |

FOREIGN PATENT DOCUMENTS

| | | | | |
|---|---|---|---|---|
| GB | 2281020 | * | 2/1995 | A41D/13/10 |

* cited by examiner

*Primary Examiner*—Katherine M. Moran
(74) *Attorney, Agent, or Firm*—Brown & Michaels, PC; Eugene Stephens & Associates

(57) ABSTRACT

A palm face of a soccer goalkeeper glove is provided with a strand mesh secured at wrist and fingertip regions to strengthen back bending resistance of the thumb and fingers of the glove. The mesh can extend across spaces between the thumb and fingers of the glove, and can extend over fingertip regions of the glove to be bonded to back sides of the fingertip regions. The strand mesh can have screen or other configurations, and can be formed in a continuous laminate extending over the palm face of the glove. The goal is to reduce injuries from back bending of a goalkeeper's fingers from impact by soccer balls traveling at high velocities.

31 Claims, 11 Drawing Sheets

SOCCER GOALKEEPER GLOVE

RELATED APPLICATIONS

This application claims the benefit of U.S. Provisional Application No. 60/358,607, filed on Feb. 21, 2002, entitled Soccer Goalkeeper Glove, Alfred F. Lucas Jr., inventor, which provisional application is incorporated by reference herein,

TECHNICAL FIELD

Gloves worn by soccer goalkeepers. (In most of the world the sport known in the US as "soccer" is called "football".)

BACKGROUND

Soccer goalkeepers typically wear gloves, which offer some padding to protect hands from the impact of balls traveling at high velocity. Gloves for soccer keepers have to allow normal hand movements and finger sensitivity, because the gloved hands of the goalkeeper are also used for throwing the ball, punching the ball, and carrying the ball. Gloves such as worn by baseball players and ice hockey goalies would not work for soccer keepers, who must preserve the feel of their hands on the ball to accomplish not only catching, but carrying, throwing, and punching the ball.

Injured fingers are a special hazard faced by soccer goalkeepers. In their efforts to catch or deflect balls traveling toward them at high velocity, it frequently happens that a ball will hit a goalkeeper's hand in such a way as to bend fingers backward. The ordinary gloves that soccer keepers wear do not prevent this, and although some gloves have recently been aimed at better finger protection for soccer keepers, such gloves have not satisfactorily met the requirements for both protecting fingers and preserving freedom of movement and feel for the ball.

SUMMARY

The invention of this application aims at a soccer goalkeeper glove that provides substantial protection against thumb or fingers bending backward, while still affording all the ball handling feel necessary for optimum performance. In accomplishing this, the invention recognizes several ways that tension resistant or stretch resistant material can be arranged over the palm face of gloves for soccer goalkeepers in a way that strongly resists back bending of the thumb or fingers wearing the glove. The invention also enhances this back bending protection by providing webbing or inter connections between thumb and fingers of the glove so that adjacent fingers can help resist any back bending force from ball impact on one of the fingers. The invention also arranges these expedients in a way that does not impair the glove wearer's sense of ball feel or reduce the wearer's performance in catching, carrying, throwing, and punching the soccer ball.

DRAWINGS

DETAILED DESCRIPTION

Figure 1:
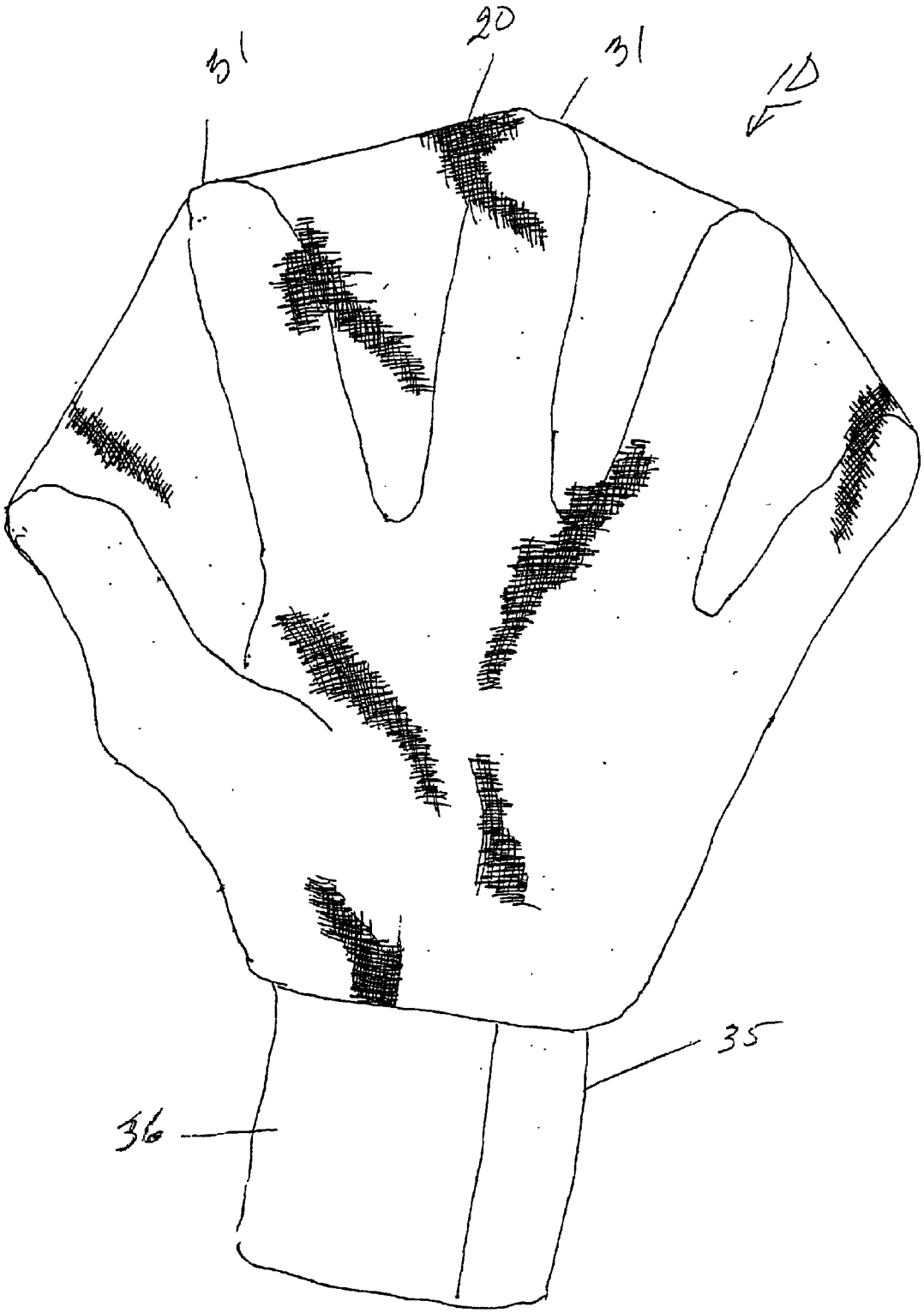
FIG. 1 is a front elevational view of a left-hand specimen of a preferred embodiment of the inventive soccer goalkeeper glove.
Figure 2:
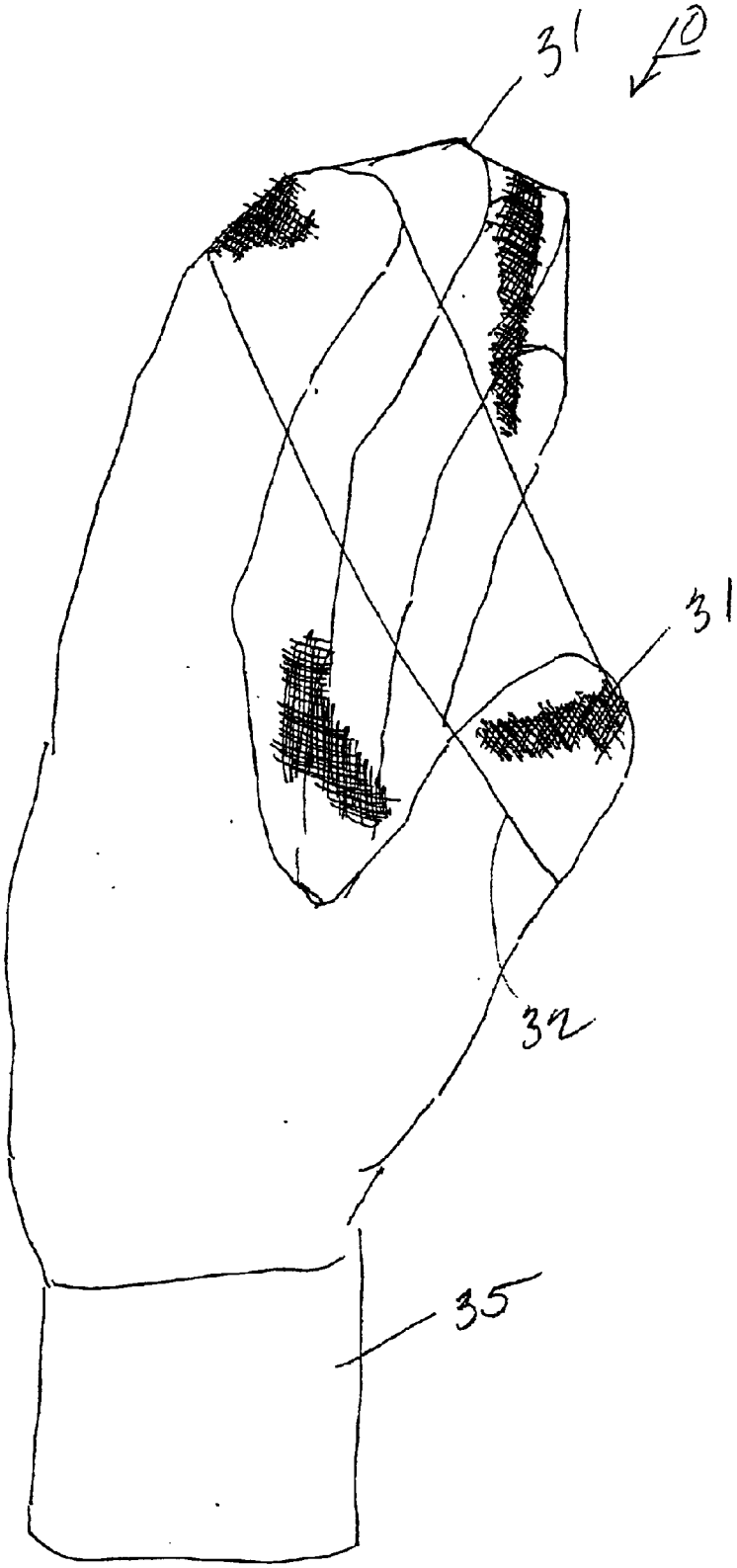
FIG. 2 is a side elevational view of the glove of FIG. 1.
Figure 5:
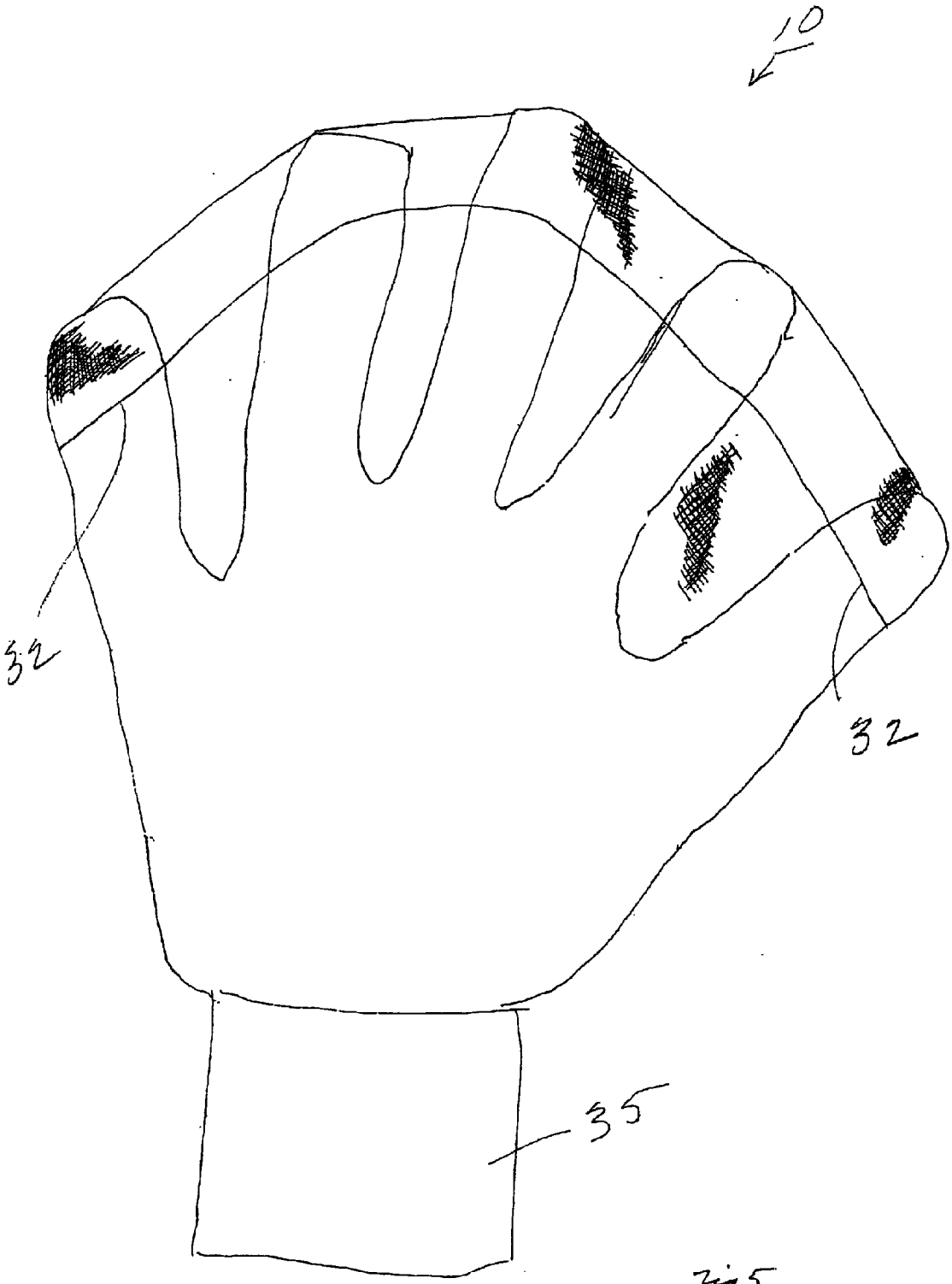
FIG. 5 is a rear elevational view of the glove of FIGS. 1 and 2.

A preferred embodiment of a left handed glove 10 shown in FIGS. 1, 2, and 5 illustrates one of the many ways that a flexible and stretch resistant strand material 20 can be arranged over a palm face of a glove to resist back bending of gloved thumb or fingers upon impact with a soccer ball. The theory of operation of glove 10 is that flexible strand material 20, while secured to a face or palm side of glove 10 can allow gloved fingers freedom of movement and adequate ball handling feel while being substantially non-stretchable so as to resist back bending of the gloved thumb or fingers.

Such back bending resistance is accomplished in two ways. First, the flexible material preferably interconnects thumb and fingers of glove 10 as illustrated so that each finger can help supply resistance to back bending stress on an adjacent finger. Second, material 20 being bonded to and extending over a palm face of glove 10 forms a strand laminate secured to a palm face surface of glove 10 so that back bending of a finger forces material 20 into a stretched or elongated curve that material 20 resists by being substantially non-stretchable. An analogy is a multi-layered laminate formed in a curve or a plane and resistant to bending into a different shape. Any such bending requires a laminate that will form an outer layer on a bent curve to be stretched to allow the bending. If the laminate is non-stretchable, it can highly resist any such bending.

Material 20 can be incorporated into a laminate forming a palm face of glove 10 so that it is not visible or is visible only in gaps between fingers and thumb. On the other hand, material 20 can also be attached or secured to a palm face of glove 10 without necessarily being laminated fully to the palm face of the glove. Material 20 is preferably secured to the palm face of glove 10 at a plurality of regions of the palm face of glove 10 so that its stretch resistance can be deployed to resist injury from back bending of a thumb or finger within the glove.

Figure 4:
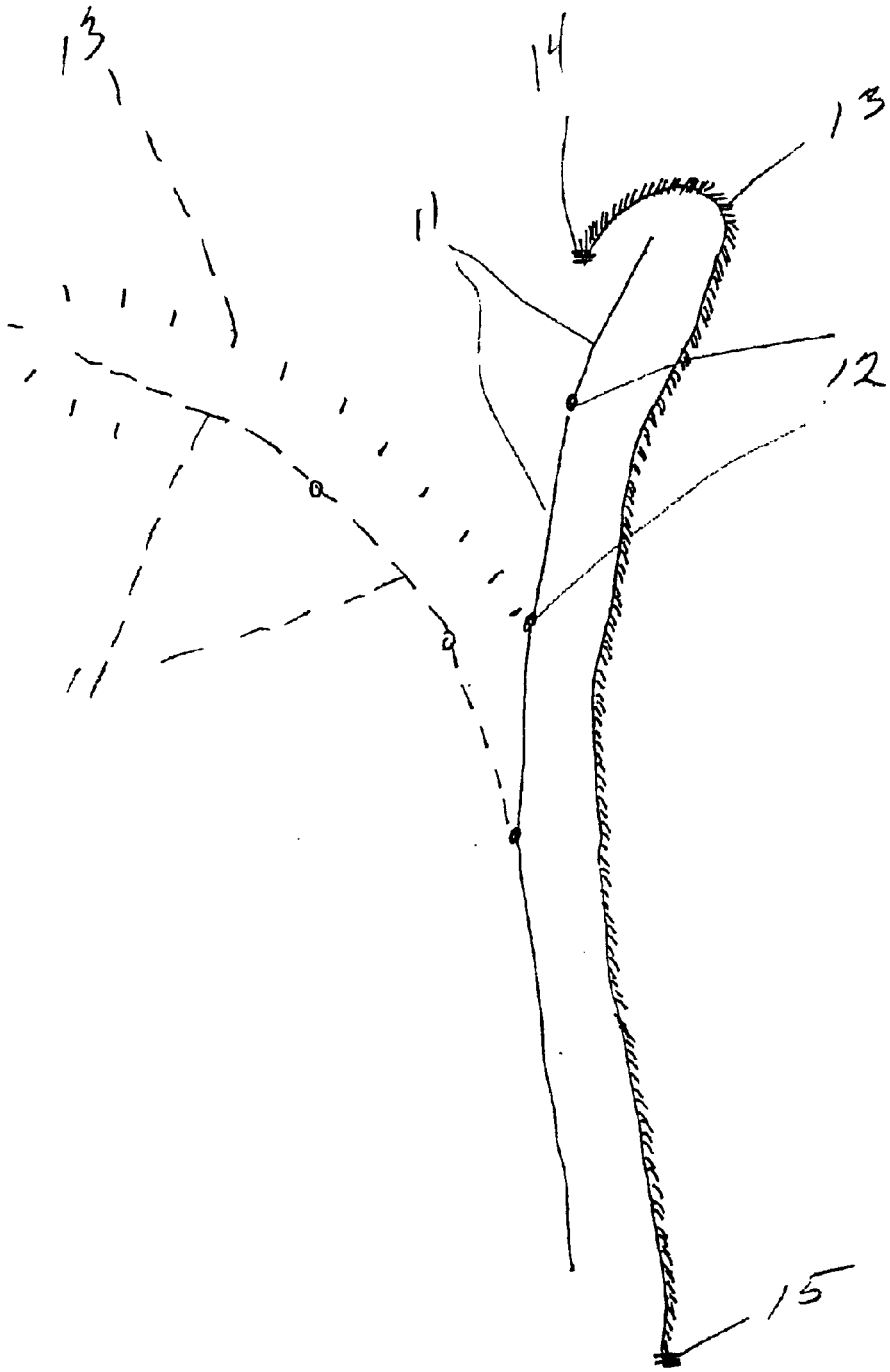
FIG. 4 is a schematic diagram illustrating mechanics of a laminate-like finger bracing action accomplished by the inventive glove.

The stretch resistant laminate principle is schematically illustrated in FIG. 4. Lines 11 schematically represent finger bones connected at joints 12, and closely stroked line 13 represents a non-stretchable glove laminate extending from an anchor point 14 on a back side of a finger to an anchor point 15 at a wrist region of a glove. The strand or mesh material represented by stroked line 13 is preferably bonded to a palm face of a glove to be disposed on a palm side of a finger as illustrated. If finger bones 11 are forced backward toward the positions of broken lines 11, then the strand mesh, or screen material is forced to stretch along widely stroked line 13. A non-stretchable material will strongly resist extension along widely stroked line 13, and will thus resist back bending of fingers.

Several working prototypes of glove 10 have been successfully demonstrated using nylon screening for flexible and non-stretchable material 20. A wide variety of screenings materials exist, and screens can be made of various polymer materials that may be satisfactorily flexible and stretch resistant. Screen, mesh, or strand material need not be polymeric, so long as it is sufficiently flexible, durable, and stretch resistant. Preferred screening has strands attached to each other at crossing points and is lightweight and cost effective. It also must be flexible and durable enough to survive countless flexures during hand movements required in play. Mesh dimensions of screening or netting 20 do not appear to be critical, and readily available mesh dimensions appear to be satisfactory.

Besides screening material having a regular crosshatched pattern, strand or mesh material specifically configured to provide tension and stress resistance along desired directions on the palm face of a glove are possible. Such especially preconfigured mesh materials can be expected to be more expensive, but may have sufficient advantages in terms of light weight, flexibility, and tension and stress resistance in the locations and directions to justify the expense for preventing injury from back bending of a thumb or finger.

Once a satisfactory flexible and stretch resistant mesh material is selected, it is preferably bonded securely to a palm surface of glove 10 to extend from wrist to fingertips. Mesh 20 also preferably extends between fingers as illustrated so that each finger can help support an adjacent finger via a mesh connection. Mesh 20 can be stitched or tacked to finger and palm regions of glove 10, and adhesives or other bonding measures may also be possible.

Bonding of strand material to glove 10 is especially important in a wrist region 35 of glove 10 and in fingertip regions 31 of glove 10 so that end regions of a strand or a mesh are securely anchored against stretching. It is also possible and preferred that a strand mesh, or screen material 20 be bonded to a palm face of glove 10 at intermediate regions between wrist 35 and thumb and fingertips 31. A continuous bond or laminate including strand mesh, or screen material can accomplish this.

As shown in FIGS. 2 and 5, strand or mesh material 20 preferably wraps over distal ends 31 of glove fingers 10 and is preferably attached to backsides 32 of glove fingers and thumb. This can be done by folding an outer perimeter of mesh 20 back on itself so that it wraps over distal ends 31 of the glove fingertips, and mesh 20 can be bonded to itself in regions spanning spaces between glove fingers and thumb. Wrapping mesh 20 over distal finger ends 31 and securing mesh 20 to back surfaces 32 of the glove fingers is preferred for providing a secure anchorage of the mesh material at the glove fingertips and for strengthening the mesh periphery between fingers.

At a wrist 35 of glove 10, as shown in FIG. 1, mesh 20 is preferably bonded to a wrist strap 36 that is preferably fastened with a hook and loop pile fastener or other fastener such as buckle, or snap. Holding mesh 20 securely at a wrist anchorage of glove 10 is preferred for insuring that mesh 20 is required to stretch before allowing back bending of glove fingers.

A secure anchorage for strands, mesh, or screen material 20 at wrist region 35 ensures that the stretch resistant material cannot slip from the wrist up toward the palm or heel of the hand and shorten the strand distance to the fingertips of the glove. A secure bond at the wrist region thus inhibits any movement of strand or mesh material toward fingertips of the glove.

Figure 7:
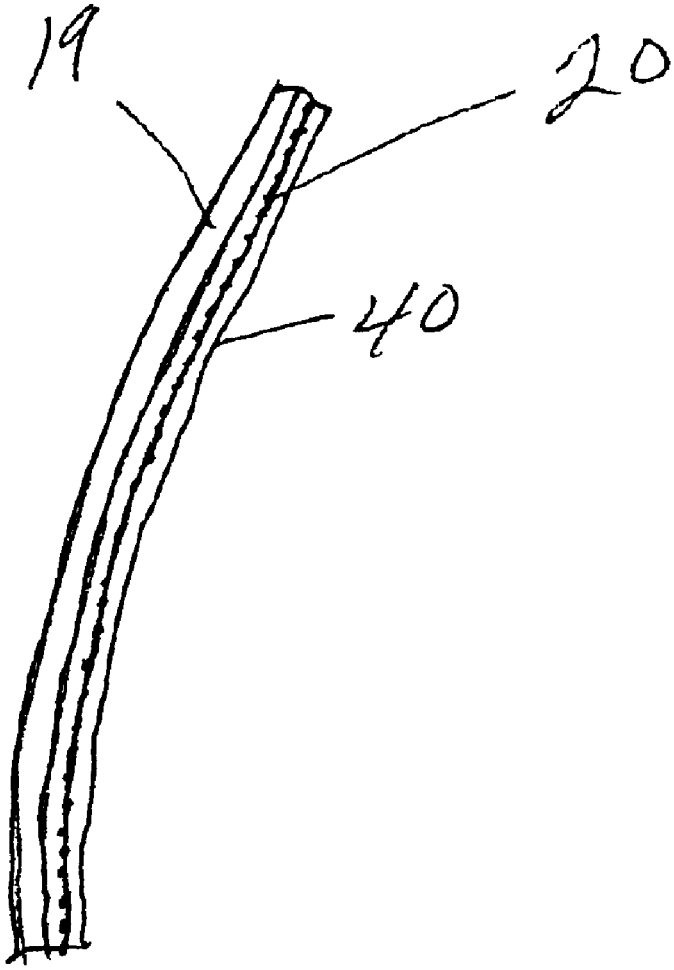
FIG. 7 is a schematic cross sectional view of layers involved in a bracing laminate used in the inventive glove.

Mesh 20 in available forms such as nylon and some other polymers can be too slippery for an effective, secure grip on a soccer ball. To remedy this and to provide a secure and inexpensive interconnection between mesh 20 and the material 19 of glove 10 I prefer a coating 40 as schematically shown in FIG. 7. Coating 40 is preferably present on glove 10 of FIGS. 1, 2, and 5 but is not illustrated in those views because its presence would obscure mesh 20. Coating 40 can also serve as a bonding material securing strand mesh 20 to face of glove 10. Coating 40 need not be co-extensive enough to cover the full palm face of glove 10, but is preferably applied in regions where a frictional grip is necessary or desirable. Glove material 19 can be any suitable fabric or leather material comfortable to the wearer, and coating material 40 is preferably an elastomer or flexible material selected for secure bonding to mesh material 20 and glove material 19. Material 40 is also selected for a high frictional engagement surface suitable for gripping a soccer ball.

Material 40 can bond mesh 20 to glove material 19 throughout the regions where mesh 20 contacts glove material 19. I prefer this for insuring that the laminate bond between mesh 20 and glove material 19 is co-extensive throughout their engagement and thus made as strong as practically possible. Coating material 40 can also fill the interstices in mesh 20 and can be applied in the regions between glove fingers. This can give glove 10 an improved appearance with a uniformly textured palm face surface. Coating 20 preferably also extends over distal finger ends 31 and into the regions where mesh 20 is bonded to the back surfaces 32 of glove fingers. Material 40 can also bond mesh 20 to wrist strap 36 for a secure anchorage at wrist region 35.

Material 40 is preferably at least as flexible as mesh 20 so as to allow free finger movement during soccer play. The combination of mesh 20 and coating 40 must allow glove fingers to come together, to bend forward into a fist, and to open to at least a finger curve matching the curve of a soccer ball. As glove fingers come together, mesh 20 and coating 40 fold in the spaces between fingers, and as glove fingers spread open to the positions illustrated, mesh 20 and coating 40 extend in planes between glove fingers.

Figure 3:
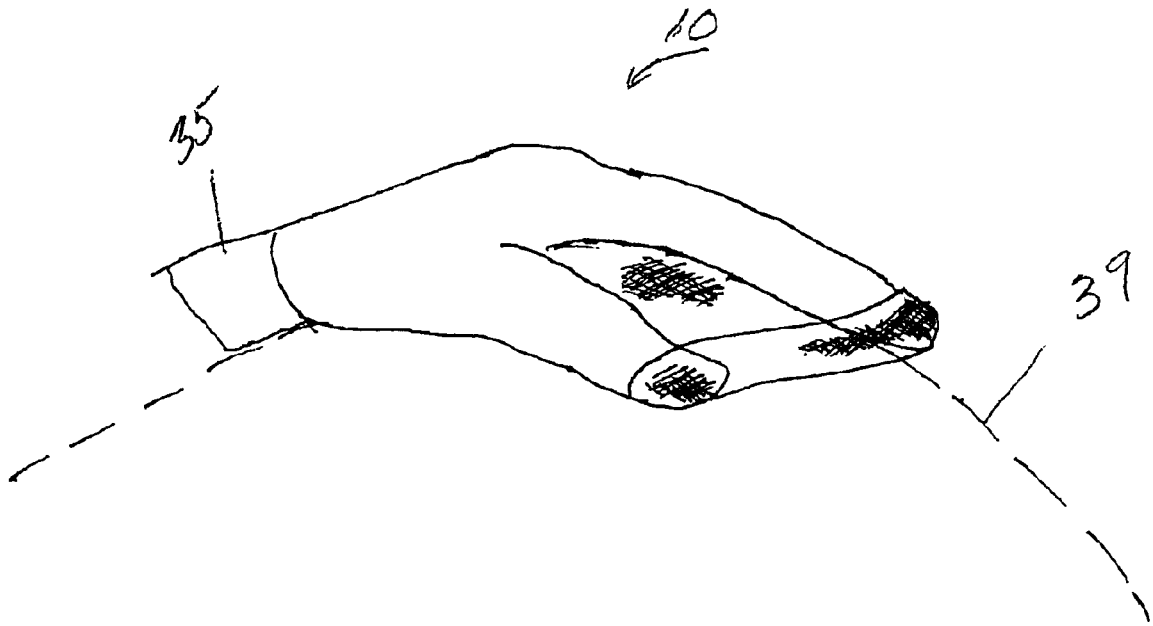
FIG. 3 is a partially schematic side view of a glove such as shown in FIGS. 1 and 2 positioned for receiving a surface coating.

When glove 10 is originally made, mesh 20 and coating 40 are preferably applied in a curved finger orientation as shown schematically by broken line 39 in FIG. 3. This establishes a laminate effect with thumb and fingers curved slightly forward, in a natural relaxed position of a hand. This results in mesh 20 and its coating 40 applying resistance to bending the fingers to a flat position from the relaxed curved position in which mesh 20 is anchored in place and coating 40 is applied. Any bending of glove fingers backward from a flat position is then resisted even more strongly. From the wearer's point of view, a feeling of security comes from sensing glove resistance when fingers and thumb bend to a flat position, which is seldom necessary during goalkeeper actions.

Curve 37, as shown in FIG. 3 represents a curved surface that may be spherical or aspherical. A radius of curvature of surface 39 to which the palm face of glove 10 conforms during manufacture is preferably approximately the radius of a soccer ball. Soccer balls for children and adults can vary in radii, and a radius of curvature for the unstressed palm face of glove 10 can range from slightly less to somewhat more than the expected radius of curvature of a soccer ball. This places the preferred radius of curvature of surface 39 in a range of 3 to 6 inches. Arranging a strand mesh in a curved laminate form on a palm face of glove 10 ensures increased resistance as gloved fingers or thumb are moved rearward from a plane of the palm of the glove.

Material 40, besides bonding mesh material 20 to glove material 19 also provides another layer in a bending resistance laminate. Although bonding material 40 is preferably an elastomer and therefor somewhat stretchable, it still adds some stretch resistance to mesh 20 to brace glove 10 against back bending of fingers. A coating that is adequately flexible but also resistant to stretching in a direction required for back bending of fingers can add even more back bending resistance by increasing palm face laminate stretch resistance.

Figure 6:
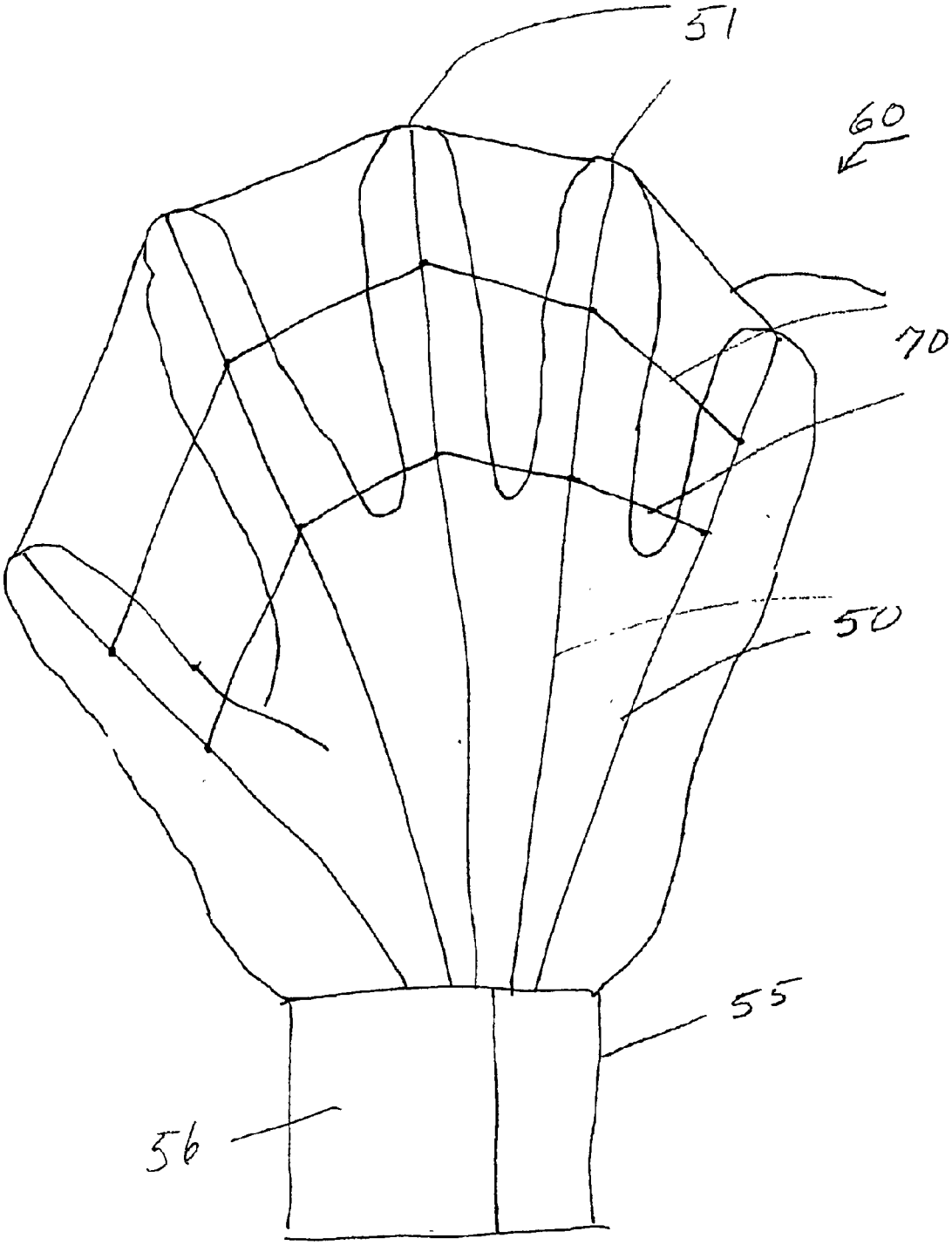
FIG. 6 is a partially schematic front elevational view of a left-hand specimen of an alternative embodiment of the inventive glove.

An alternative embodiment shown in FIG. 6 illustrates similar principles applied in a much coarser meshwork of longitudinal strands 50 extending from wrist region 55 and wrist band 56 to fingertips 51 of glove 60. Cross-strand 70 extend between distal finger ends and interconnect fingers at corresponding points along their lengths to provide inter finger sup on, and to strengthen back bending resistance provided by longitudinal strands 50. Cross-strands 70 are preferably bonded to longitudinal trands 50. A coating material can be applied to palm surfaces of glove 60 to bond strands 50 and 70 in place, but the mesh work provide by stands 50 and 70 is too coarse to support any bonding material in spaces between fingers 51.

Materials technology may suggest spider web like mesh works that are light and strong and readily bonded to glove fingers to practice the invention. If a mesh work material also provides high friction and can be securely bonded to glove material, then coating 40 can be omitted. If may also be possible to build a finger bracing laminate directly into glove material 19 as a glove is fabricated. This would involve flexible and stretch resistant material on a palm face of the glove and between glove fingers, preferably formed in an initial curvature matching a relaxed posture of the human hand, and anchored at wrist and fingertips to form the necessary back bending resistance. The rest of the glove, including the backside of the hands and fingers could be made of any comfortable material that holds the glove in place. Any preferred arrangement will subject the palm face material of the finished glove to substantial tensile stretching force before allowing back bending of the glove fingers.

Figure 8:
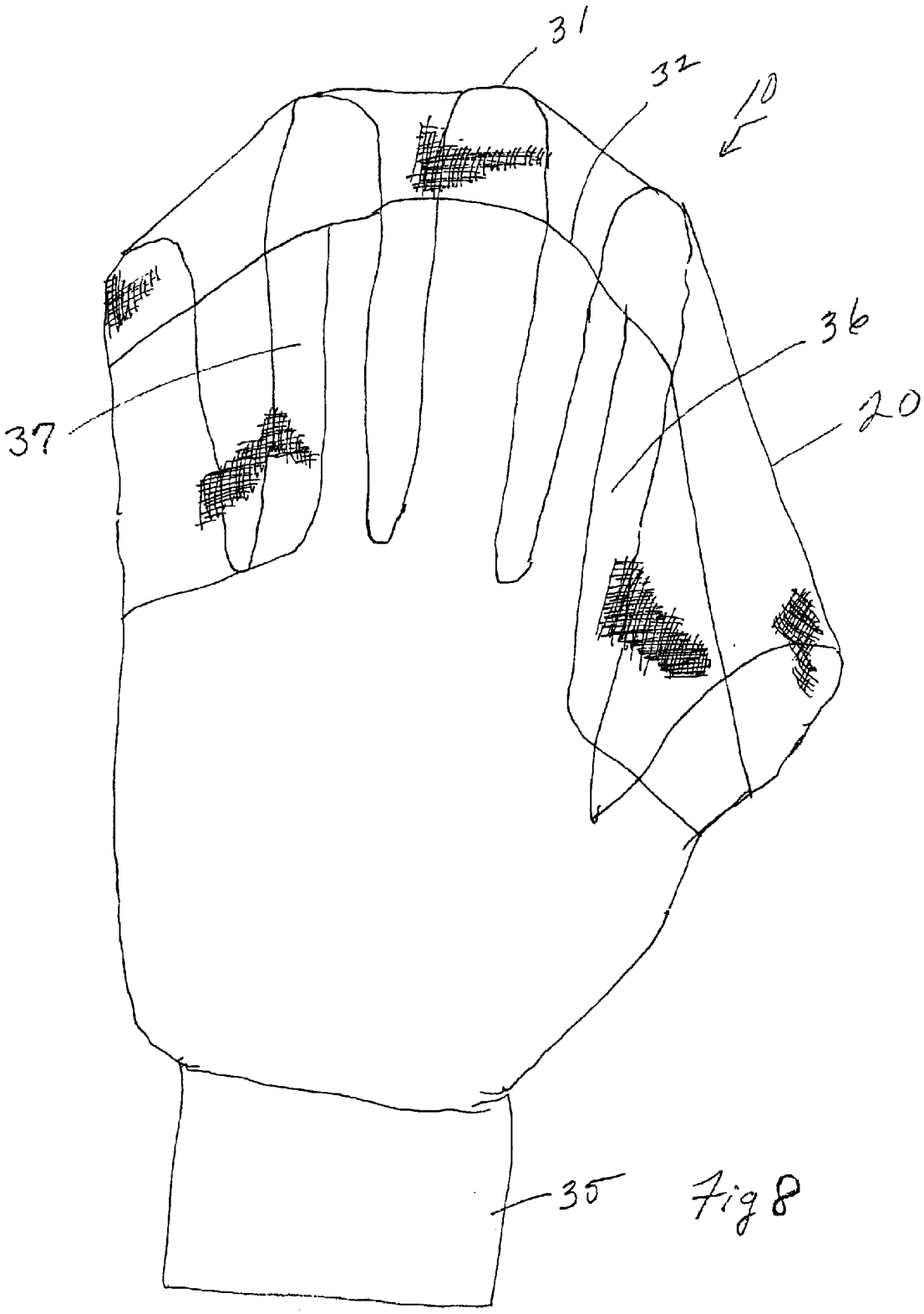
FIG. 8 is a variation of the glove of FIGS. 1 and 2 showing wrapped around rear face protection for the thumb and little finger of the glove.
Figure 9:
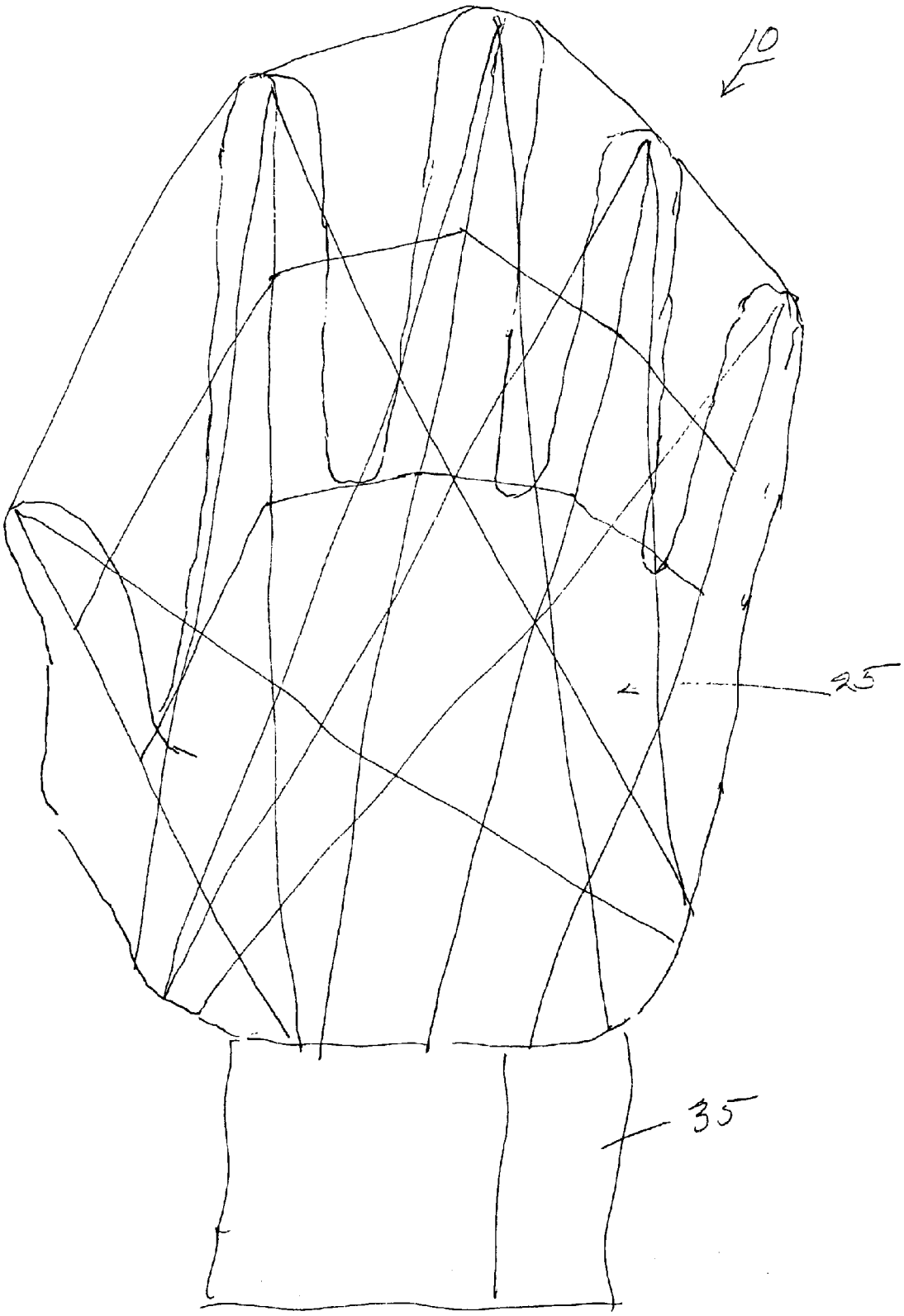
FIG. 9 is a partially schematic front elevational view of a left-handed specimen of another alternative embodiment of the inventive glove emphasizing triangulation of the protective strands.

FIG. 8 illustrate a variation of the FIG. 5 embodiment having additional side folds of mesh material 20 around the thumb and little finger. These digits are most vulnerable to bending backward, because they are not supported on both sides by other fingers. Extending a palm face of strand mesh 20 so as to wrap around the thumb and little finger regions of the glove and attach to the backside of the glove increases back bending support for the thumb and little finger. In the variation shown in FIG. 8, a strand material portion 46 that is wrapped around the thumb preferably extends to and is bonded to the backside of the index finger, as illustrated. Another strand mesh portion 47 wrapped around the little finger preferably extends to and is bonded to a back face of the ring finger, as illustrated. Many other arrangements are possible.

Figure 10:
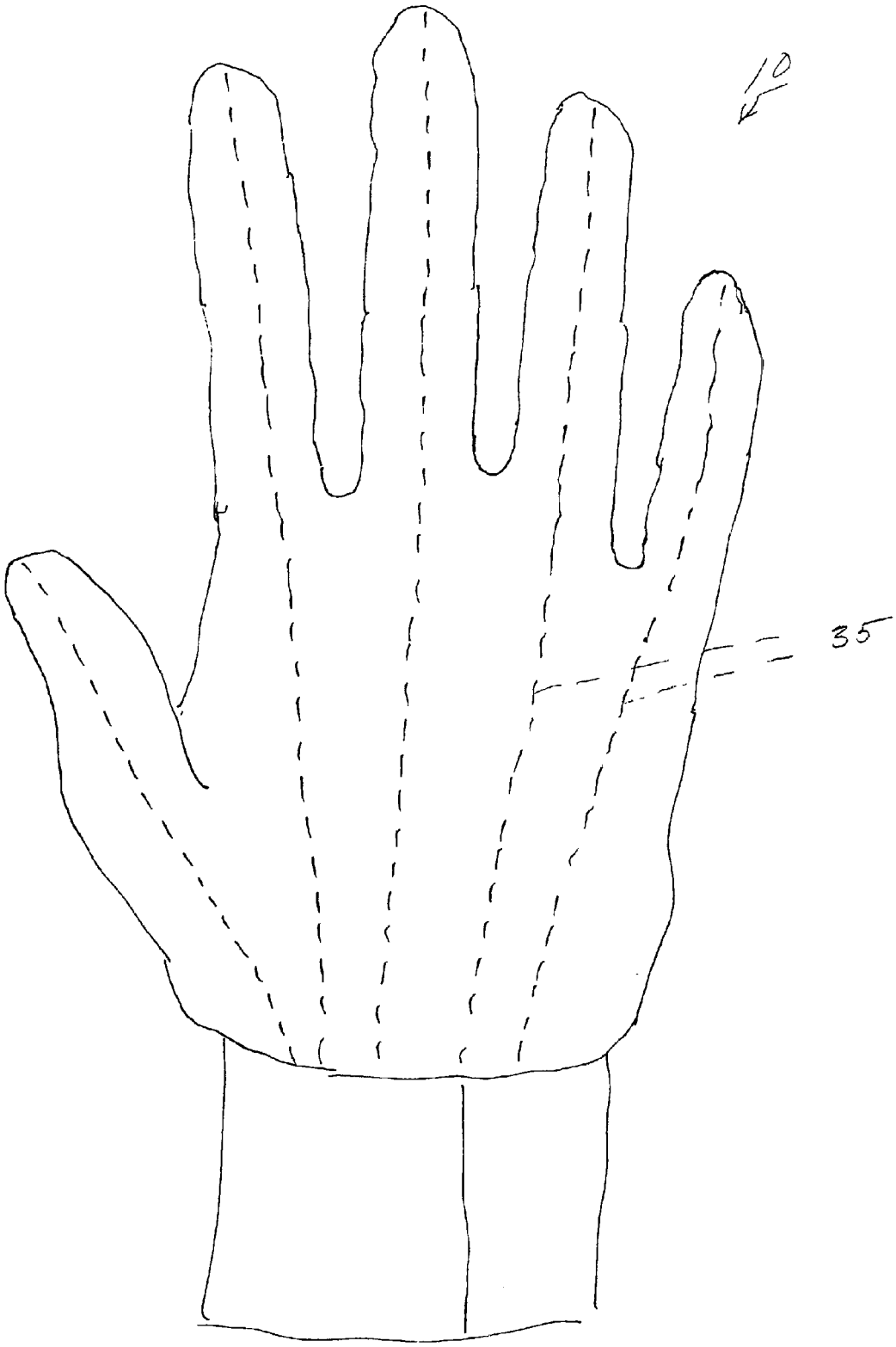
FIG. 10 is a partially schematic front elevational view of a left-handed specimen of a palm face of the inventive glove showing approximate locations of tendon lines for the thumb and fingers of the glove.

The schematic embodiment of an unstranded glove 10, as shown in FIG. 10, illustrate approximate thumb and finger tendon lines 45 shown in broken lines. Lines 45 follow generally and approximately along bone and tendon structure lines of a thumb and fingers within glove 10. These lines are the ones that benefit most from back bending reinforcement when a strand mesh is later applied to the glove 10 of FIG. 10. Strands of a mesh need not follow directly along tendon lines 45 but any mesh or screen material applied to the palm face of glove 10 must have tension and stress resistance effectively applied along tendon lines 45.

Figure 11:
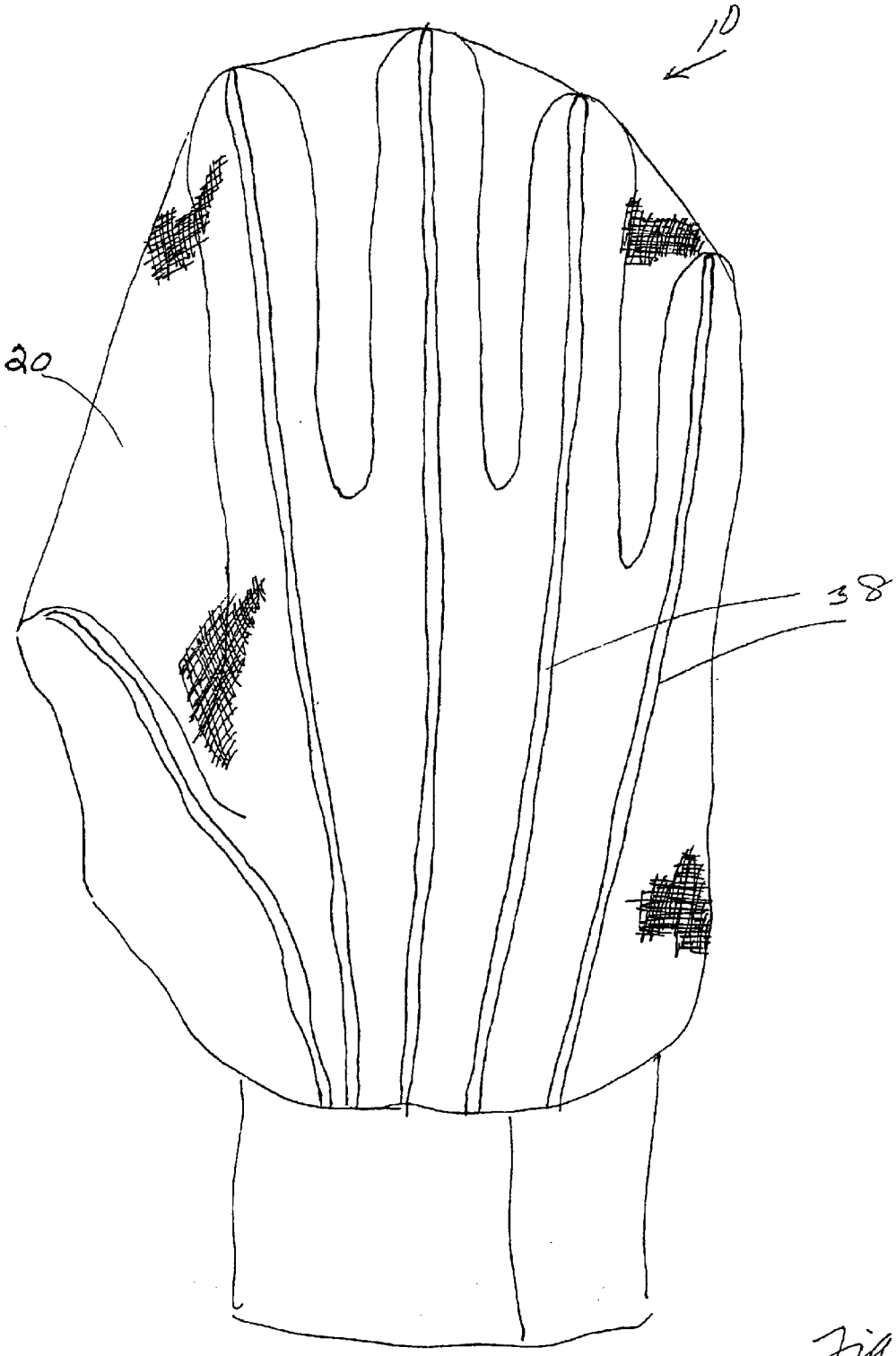
FIG. 11 is a partially schematic palm face view of a left-handed specimen of a variation of the inventive glove showing strand mesh bonding lines extending along tendon lines for the thumb and fingers of the glove.

The glove 10 of FIG. 11 shows bonding or friction material 38 arranged along thumb and finger tendon lines. Material 38 can enhance a frictional grip of glove 10, and can also accomplish bonding of mesh 20 to the palm ace of glove 10. Frictional material 38 can also be arranged or extended into other regions of the palm face of glove 10, but is especially effective when arranged along tendon lines, as shown in FIG. 11.

I claim:

1. A soccer goalkeeper glove having a wrist region, a palm face, and a thumb and fingers fitting the hand of a wearer, the glove comprising:

a. flexible and substantially unstretchable longitudinal strands extending from the wrist region to and inclusive of a portion of the thumb and fingers;

b. flexible and substantially unstretchable cross strands extending between and secured to tip regions of the thumb and fingers:

c. the flexibility of the strands enabling the wearer's fingers to move apart and together and to substantially form a fist; and d. the longitudinal strands being secured to the glove so that tension resistant regions are formed on the palm face of the glove causing the longitudinal strands to resist bending the thumb or fingers of the wearer's hand back from a plane of the palm of the glove and such back bending resistance is enhanced by the cross strands.

2. The glove of claim 1 wherein the strands are secured to the glove at the wrist region and at the tip regions of the thumb and fingers.

3. The glove of claim 1 wherein a wrist strap secures the strands at the wrist region of the glove to a wrist of the wearer so that the strands at the wrist region of the glove are not free to move toward the tip regions of the thumb and fingers.

4. A soccer goalkeeper glove comprising:

a. a palm face of the glove including a flexible strand mesh extending from a wrist region of the glove to tip regions of a thumb and fingers of the glove and extending across regions between the thumb and fingers of the glove;

b. the mesh being secured to the glove at the wrist region and the tip regions of the thumb and fingers;

c. a wrist strap securing the mesh in the wrist region of the glove to a wrist of the wearer to limit movement of the wrist region of the mesh toward the tip regions of the thumb and fingers;

d. the palm face of the glove being configured in an unstressed condition to conform the thumb and fingers to a curved surface having a radius of curvature of approximately 3–6 inches;

e. strands of the mesh having substantial tensile strength along thumb and finger tendon lines of the glove, being substantially unstretchable, and being secured to each other at crossing points of the mesh; and f. the mesh being arranged so when the glove is on a goalkeeper's hand the mesh resists flattening of the palm and fingers of the glove in a plane and strongly resists bending back a thumb or finger of the goalkeeper's hand from a plane of the palm of the glove.

5. The glove of claim 4 wherein the mesh is a polymeric screen material.

6. The glove of claim 4 wherein the mesh is bonded to the palm face of the glove with a high coefficient of friction material.

7. The glove of claim 4 wherein the mesh is arranged to allow gloved fingers of the goalkeeper's hand to move to together, move apart, and curl into a fist.

8. The glove of claim 4 wherein the mesh is included in a laminate forming the palm face of the glove.

9. The glove of claim 4 wherein the mesh extends over the tip regions of the thumb and fingers and is secured to rear faces of the thumb and fingers of the glove.

10. The glove of claim 4 wherein the mesh extends from a palm face of the thumb around a back face of the thumb and is attached to a back face of the glove.

11. The glove of claim 4 wherein the mesh extends around a palm face of a little finger of the glove and around a back face of the little finger and is attached to a back face of the glove.

12. A soccer goalkeeper glove having a thumb, fingers, a palm face, a back face, and a wrist region all fitting a hand of a goalkeeper, the glove when arranged on the hand of the goalkeeper comprising:

a. flexible and substantially nonstretchable strands arranged on the palm face of the glove where they are disposed on a palm side of a thumb and fingers of the goalkeeper's hand;

b. a longitudinal portion of the strands being secured to the glove at the wrist region of the glove and at tip regions of the thumb and fingers of the glove and a transverse portion of the strands being secured to the glove to extend between the thumb and fingers of the glove;

c. the strands being secured to the palm face of the glove in regions between the wrist region and the tip regions of the thumb and fingers;

d. a wrist strap securing the longitudinal portion of the strands at the wrist region of the glove to a wrist of the goalkeeper's hand to anchor the strands at the goalkeeper's wrist;

e. with the hand of the goalkeeper in a relaxed position within the glove, the strands being arranged in unstressed positions along insides of forward curves of the goalkeeper's fingers and the love fingers;

f. the length of the strands and the securing of the strands to the palm face of the glove being arranged to subject the strands to stress if the forward curves of the glove fingers are bent back; and g. the combination of the longitudinal and transverse portions of the strands providing sufficient tensile strength resistance to reduce injury from bending the thumb or fingers of the goalkeeper's hand rearward from a plane of the palm of the glove.

13. The glove of claim 12 wherein the strands extend across spaces between the thumb and fingers of the glove.

14. The glove of claim 12 wherein the strands are formed as a mesh and the strands are secured to each other at strand crossings of the mesh.

15. The glove of claim 12 wherein the strands are incorporated into a laminate forming the palm face of the glove.

16. The glove of claim 12 wherein the strands are bonded to the palm face of the glove with a high co-efficient of friction bonding material.

17. The glove of claim 12 wherein the strands extend over the tip regions of the thumb and fingers and are secured to back sides of the thumb and fingers of the glove.

18. A soccer goalkeeper glove having a thumb, fingers, a palm face, a back face, a wrist region, and a wrist strap all fitting a wrist and hand of a goalkeeper, the glove comprising:

a. the palm face of the glove being formed as a laminate including a flexible strand mesh extending from the wrist region of the glove to tip regions of the thumb and fingers of the glove and extending across regions between the thumb and fingers of the glove;

b. the strands of the mesh having substantial tensile strength, being substantially unstretchable, and being secured to each other at crossing points of the mesh;

c. the wrist strap being arranged to anchor the mesh at the goalkeeper's wrist to inhibit movement of the mesh toward the tip regions of the thumb and fingers of the glove;

d. the palm face of the glove being configured in an unstressed condition to conform the thumb and fingers of the love to a curved surface having a radius of curvature of approximately 3–6 inches;

e. the mesh being disposed on palm face of the glove to extend along the curved surface forward of a thumb, fingers, and palm of the goalkeeper's hand; and f. the tensile strength of the mesh being sufficient to substantially resist being disposed on an outside of a curve formed by bending back the thumb or fingers of the goalkeeper's hand from a plane of the palm of the glove.

19. The glove of claim 18 wherein the mesh is a polymeric screen material.

20. The glove of claim 18 wherein the mesh is flexible enough to allow gloved fingers of the goalkeeper's hand to move together, move apart, and curl into a fist.

21. The glove of claim 18 wherein the mesh extends over the tip regions of the thumb and fingers and is secured to rear faces of the thumb and fingers of the glove.

22. A soccer goalkeeper glove having a thumb, fingers, a palm face, and a back face fitting a hand of a goalkeeper, the glove also having a wrist region and a wrist strap fitting a wrist and hand of a goalkeeper, the glove comprising:

a. the palm face of the glove including a laminate extending from the wrist region of the glove to tip regions of the thumb and fingers of the glove;

b. the palm face of the glove being configured in an unstressed condition to conform the laminate to a curved surface having a radius of curvature of approximately 3–6 inches extending over the palm face of the glove and over the thumb and finger regions of the glove;

c. the wrist strap being arranged to anchor the laminate at the goalkeeper's wrist to inhibit movement of the laminate toward the tip regions of the thumb and fingers of the glove;

d. the laminate having substantial tensile strength and substantial stretch resistance;

e. the tensile strength and stretch resistance of the laminate in a palm region of the glove extending between the wrist strap and the tip regions of the thumb and fingers being sufficient to substantially resist being disposed on an outside of a curve formed by bending back a thumb or finger of the goalkeeper's glove from a plane of the palm of the goalkeeper's hand in response to a thumb or finger of the goalkeeper being hit by a soccer ball traveling at high velocity;

f. a material extending between the thumb and fingers of the glove being flexible and stretch resistant and dimensioned to allow the thumb and fingers of the glove and of the goalkeeper's hand in the glove to spread apart from each other sufficiently to accommodate hand actions of the goalkeeper; and g. the tensile strength and stretch resistance of the material extending between the thumb and fingers of the glove being sufficient to resist back bending of any one of the thumb and fingers hit by a soccer ball traveling at high velocity.

23. The glove of claim 22 wherein the laminate includes a mesh material.

24. The glove of claim 22 wherein the laminate extends over the thumb and finger tip regions to the back face of the glove in the thumb and finger tip regions.

25. The glove of claim 22 wherein the laminate forms the material extending between the thumb and fingers of the glove.

26. A soccer goalkeeper glove having a wrist region, a palm face, and a thumb and fingers fitting the hand of a wearer, the glove comprising:

a. flexible and substantially unstretchable polymeric strands extending from the wrist region to tip regions of the thumb and fingers and also extending between the thumb and fingers;

b. the strands being secured to each other at strand crossings and to the palm face of the glove at the wrist region and at the tip regions of the thumb and fingers;

c. the flexibility of the strands being arranged to allow the wearer's fingers to move apart and together and to form a fist;

d. a wrist strap securing the strands at the wrist region of the glove to a wrist of the wearer so that the strands at the wrist region of the glove are not free to move toward the tip regions of the thumb and fingers; and e. the securing of the strands being arranged to form tension resistant regions on the palm face of the glove extending along tendon lines of the wearer's hand so that the strands resist bending the thumb or fingers of the wearer's hand back from a plane of the palm of the glove.

27. A soccer goalkeeper glove having a wrist region, a palm face, and a thumb and finger fitting the hand of a wearer, the glove comprising:

a. flexible and substantially unstretchable polymeric strands extending from the wrist region to tip regions of the thumb and fingers and also extending between the thumb and fingers;

b. the strands being formed as a mesh and secured to the palm face of the glove at the wrist region and at the tip regions of the thumb and fingers;

c. the flexibility of the strands being arranged to allow the wearer's fingers to move apart and together and to form a fist;

d. a wrist strap securing the strands at the wrist region of the glove to a wrist of the wearer so that the strands at the wrist region of the glove are not free to move toward the tip regions of the thumb and fingers; and e. the securing of the strands being arranged to form tension resistant regions on the palm face of the glove extending along tendon lines of the wearer's hand so that the strands resist bending the thumb or fingers of the wearer's hand back from a plane of the palm of the glove.

28. A soccer goalkeeper glove having a wrist region, a palm face, and a thumb and fingers fitting the hand of a wearer, the glove comprising:

a. flexible and substantially unstretchable polymeric strands extending from the wrist region to tip regions of the thumb and fingers and also extending between the thumb and fingers;

b. the strands being included in a laminate forming the palm face of the glove and secured to the palm face of the glove at the wrist region and at the wrist regions of the thumb and fingers;

c. the flexibility of the strands being arranged to allow the wearer's fingers to move apart and together and to form a fist;

d. a wrist strap securing the strands at the wrist region of the glove to a wrist of the wearer so that the strands at the wrist region of the glove are not free to move toward the tip regions of the thumb and fingers; and e. the securing of the strands being arranged to form tension resistant regions on the palm face of the glove extending along tendon lines of the wearer's hand so that the strands resist bending the thumb or fingers of the wearer's hand back from a plane of the palm of the glove.

29. A soccer goalkeeper glove having a wrist region, a palm face, and a thumb and fingers fitting the hand of a wearer, the glove comprising:

a. flexible and substantially unstretchable polymeric strands extending from the wrist region to tip regions of the thumb and fingers and also extending between the thumb and fingers;

b. the strands being secured to the palm face of the glove at the wrist region and at the tip regions of the thumb and fingers;

c. the flexibility of the strands being arranged to allow the wearer's fingers to move apart and together and to form a fist;

d. a wrist strap securing the strands at the wrist region of the glove to a wrist of the wearer so that the strands at the wrist region of the glove are not free to move toward the tip regions of the thumb and fingers;

e. the securing of the strands being arranged to form tension resistant regions on the palm face of the glove extending along tendon lines of the wearer's hand so that the strands resist bending the thumb or fingers of the wearer's hand back from a plane of the palm of the glove; and f. wherein the palm face of the glove in an unstressed condition conforms the thumb and fingers to a curved surface having a radius of about 3–6 inches.

30. A soccer goalkeeper glove having a wrist region, a palm face, and a thumb and fingers fitting the hand of a wearer, the glove comprising:

a. flexible and substantially unstretchable polymeric strands extending from the wrist region to tip regions of the thumb and fingers and also extending between the thumb and fingers;

b. the strands being secured to the palm face of the glove at the wrist region and at the tip regions of the thumb and fingers and being extended over the tip regions of the thumb and fingers and secured to back sides of the thumb and fingers;

c. the flexibility of the strands being arranged to allow the wearer's fingers to move apart and together and to form a fist;

d. a wrist strap securing the strands at the wrist region of the glove to a wrist of the wearer so that the strands at the wrist region of the glove are not free to move toward the tip regions of the thumb and fingers; and e. the securing of the strands being arranged to form tension resistant regions on the palm face of the glove extending along tendon lines of the wearer's hand so that the strands resist bending the thumb or fingers of the wearer's hand back from a plane of the palm of the glove.

31. A soccer goalkeeper glove having a wrist region, a palm face, and a thumb and fingers fitting the hand of a wearer, the glove comprising:

a. flexible and substantially unstretchable polymeric strands extending from the wrist region to tip regions of the thumb and fingers and also extending between the thumb and fingers and from a palm face of the thumb and little finger around outsides of the thumb and little finger and over back sides of the thumb and little finger to anchorages on a back face of the glove;

b. the strands being secured to palm face of the glove at the wrist region and at the tip regions of the thumb and fingers;

c. the flexibility of the strands being arranged to allow the wearer's fingers to move apart and together and to form a fist;

d. a wrist strap securing the strands at the wrist region of the glove to a wrist of the wearer so that the strands at the wrist region of the glove are not free to move toward the tip regions of the thumb and fingers; and e. the securing of the strands being arranged to form tension resistant regions on the palm face of the glove extending along tendon lines of the wearer's hand so that the strands resist bending the thumb or fingers of the wearer's hand back from a plane of the palm of the glove.

* * * * *